US006273048B1

(12) United States Patent
Kargilis

(10) Patent No.: US 6,273,048 B1
(45) Date of Patent: Aug. 14, 2001

(54) VACUUM RESERVOIR

(75) Inventor: John S Kargilis, Northville, MI (US)

(73) Assignee: DaimlerChrsler Corporation, Auburn Hills, MI (US)

( * ) Notice: Subject to any disclaimer, the term of this patent is extended or adjusted under 35 U.S.C. 154(b) by 0 days.

(21) Appl. No.: 09/471,686

(22) Filed: Dec. 23, 1999

(51) Int. Cl.[7] ..... F02M 35/12
(52) U.S. Cl. ..... 123/184.57
(58) Field of Search ..... 123/184.21, 184.24, 123/184.26, 184.34, 184.36, 184.42, 184.44, 184.47, 184.49, 184.53, 184.54, 184.57, 184.61

(56) References Cited

U.S. PATENT DOCUMENTS

| | | | |
|---|---|---|---|
| 2,857,988 | 10/1958 | Stelzer . | |
| 2,910,327 | 10/1959 | Blair . | |
| 4,497,286 | 2/1985 | Masuda . | |
| 4,538,556 | 9/1985 | Takeda . | |
| 5,027,598 | 7/1991 | Meynier . | |
| 5,048,469 * | 9/1991 | Spray | 123/184.42 |
| 5,226,400 * | 7/1993 | Birch | 123/557 |
| 5,704,325 * | 1/1998 | Sattler et al. | 123/184.42 |

FOREIGN PATENT DOCUMENTS

| | | | |
|---|---|---|---|
| 0657201A3 * | 6/1995 | (EP) | B01D/35/30 |
| 2239048 * | 6/1991 | (GB) | 123/184.57 |

* cited by examiner

*Primary Examiner*—Noah P. Kamen
*Assistant Examiner*—Hai Huynh
(74) *Attorney, Agent, or Firm*—Mark P. Calcaterra

(57) ABSTRACT

An intake manifold with vacuum storage for a vehicle engine defined by an integrally formed enclosure assembly for the manifold and for the vacuum storage. The intake manifold portion of the enclosure assembly defines a plenum space and a plurality of branch runners fluidly connected to an air inlet for providing air flow into the associated engine. The vacuum storage portion of the enclosure assembly defines a storage space for vacuum. A passageway extends between the plenum space and the vacuum storage space and a check valve is provided therein to allow air flow from the vacuum storage space into the plenum space to block air flow from the plenum space into the vacuum storage space.

9 Claims, 1 Drawing Sheet

VACUUM RESERVOIR

FIELD OF THE INVENTION

The field of the present invention is that of intake manifolds for an internal combustion engine.

DESCRIPTION OF PRIOR ART

For sometime, efforts have been made to increase the fuel economy of automotive vehicles. To achieve increased fuel economy, several technical trends have developed. One technical trend which has been utilized to increase fuel economy is to utilize smaller V-6 or inline 4 cylinder engines instead of V-8 engines. Still another technical trend to increase fuel economy is to make the vehicle lighter.

One example of how an automotive component can be made lighter is intake manifolds formed from plastics. These new manifolds can withstand high temperatures and can be injection molded or blow molded. Previously, many if not most of automotive intake manifolds were made from cast aluminum.

The majority of vehicles have at least two or three components which are vacuum actuated. Vacuum actuated components include vacuum assistant power brake boosters and other components such as cruise control or secondary manifold runner valves (typically utilized on some high performance vehicles). Additionally, other components are vacuum actuated such as many of the gate values actuators in the heating, ventilation and air conditioning system of the vehicle.

The suction action of an engine piston reciprocating in a cylinder of an internal combustion engine is typically how vacuum is generated. This vacuum capacity is relied upon in many applications in an automotive vehicle. The aforementioned trend from large V-8 engines with large displacement to smaller 4 or 6-cylinder engine much smaller displacements has decreased the potential generation of large amounts of vacuum. Vacuum capacity is especially diminished when a small displacement engine is operating at open throttle conditions. According, vacuum storage accumulators (commonly referred to as vacuum reservoirs) have been added to many vehicles to collect vacuum power when available for associated vacuum actuated components. A check valve is provided between the engine manifold and the vacuum reservoir to retain vacuum in the reservoir until needed. The check valve cuts off fluid connection between the vacuum reservoir in the manifold when the pressure level in the manifold increases due to operation under partial or open throttle conditions. Typically, a vacuum hose line is used to connect the manifold and the reservoir. Another vacuum hose line is required between the vacuum reservoir and the vacuum actuated component. Due to engine compartment crowding, the reservoir is often remotely located. Also, vacuum lines are often placed in vary inconvenient places and routes. Leaks in vacuum hoses can often be very hard to diagnose and very often lead to undesirable engine operation.

It would be highly desirable to consolidate the vacuum reservoir and vacuum producer. It would be highly desirable to minimize the vacuum hoses required to deliver vacuum to a vacuum reservoir. It would be highly desirable to eliminate the cost of the bracketing required for affixing a vacuum reservoir to the vehicle engine block or to car body.

SUMMARY OF THE INVENTION

In a preferred embodiment of the present invention, an engine intake manifold is combined with a vacuum reservoir. The intake manifold typically has an inlet passage for receiving filtered ambient air thereto and a plenum space which is then connected to a plurality of branches or runner passages for conducting air flow to the various engine combustion chambers. A vacuum reservoir is integrally formed with the plenum and separated therefrom by an integral wall of the manifold. A passage is formed through the integral wall to allow withdrawal of air from the reservoir to the manifold interior for creating a vacuum condition therein. The vacuum reservoir has an outlet which acts to apply a vacuum effect to any of the vehicle's several vacuum operated components. Additionally, a check valve is provided between the manifold interior and the reservoir interior. The check valve allows a one-way flow of air from the vacuum reservoir to the manifold plenum but does not permit flow from the manifold into the reservoir. The check valve permits a flow of air from the reservoir into the manifold's plenum when the engine is operated in a closed or near closed throttle condition which generates vacuum in the intake manifold. The check value prevents air flow from the manifold's plenum back into the reservoir when the engine is operated in an open or mostly open throttle condition which does not generate vacuum in the intake manifold.

It is an object of the present invention to provide an integral manifold and vacuum reservoir for an automotive engine.

It is a further object of the present invention to provide an automotive engine intake manifold assembly having an integral vacuum reservoir which assembly can be fabricated from a clam shell polymeric material which is then sonically welded together.

The above noted and other objects of the present invention will become apparent to those skilled in the art from a review of the invention as provided in the accompanying drawings and detailed description of a preferred embodiment.

DETAILED DESCRIPTION OF THE PREFERRED EMBODIMENT

Figures 1, 2:
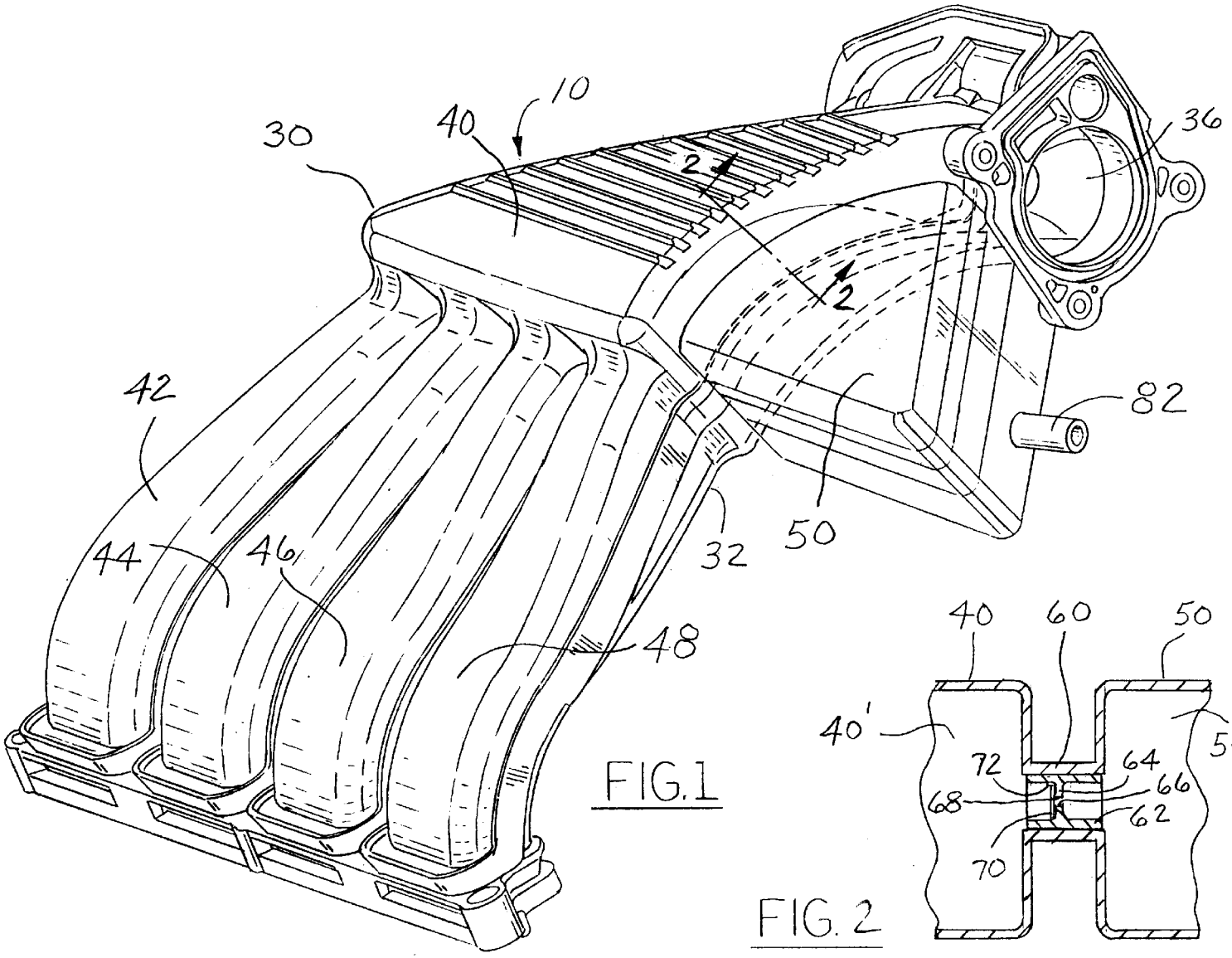
FIG. 1 is a perspective view of an engine intake manifold and vacuum reservoir according to the present invention.
FIG. 2 is a sectional view taken along line 2—2 of FIG. 1 and looking in the direction of the arrows.

FIG. 1 illustrates a preferred embodiment of the subject intake manifold 10 according to the present invention. The manifold is normally attached to an automotive engine, specifically a cylinder head thereof (not shown). Reciprocating pistons in the engine create a suction action which draws air from the manifold into combustion chambers of the engine. This action is useful to create a vacuum which can then be used for associated vacuum powered components of the vehicle.

The intake manifold 10 may be a cast metallic member or may be molded of a polymeric material. In the illustrated example, the material utilized is a nylon plastic material typically supplied by Dupont of Troy, Michigan. The nylon material can withstand temperatures of 300 degrees F and typically will be injection molded with a 2 to 3 millimeter wall thickness. As shown, the manifold 10 has a clam shell type construction an upper and a lower half 30, 32 respectively. The two halves are sonically or vibration welded together.

The manifold 10 has an inlet end forming a channel 36. The inlet 36 is connected with an outlet of an air filter assembly (not shown) which is typically used in vehicles to screen-out dirt and foreign matter from the ambient air. A typical inlet channel 36 will have a three square inch area opening. Fluidly connected with the inlet channel 36 is a plenum space formed within housing 40. The plenum housing 40 provides a volume for engine air typically at least 1.2× the engine displacement. Fluidly connected with the plenum space are a series of four branch runners 42, 44, 46 and 48 (for a four cylinder engine). The runners 42, 44, 46 and 48 are formed and arranged so as to provide a smooth air flow to each of the engine combustion chambers characterized by equal conditions of volumetric flow rate and pressure. Normally, each branch runner delivers 10,500 to 105,000 cubic inches of air per minute to a combustion chamber. At a closed throttle conditions the vacuum within the interior of the plenum 40 typically range from 19 to 25 mmHg.

Referring to FIG. 2, a vacuum reservoir 50 is formed integrally with the intake manifold channel forming portion and plenum housing 40. The vacuum reservoir 50 is integrally molded with the intake manifold 10 and particularly the plenum housing 40. A typical vacuum reservoir 50 has a 50 cubic inch volume. A passageway 60 is located between the vacuum reservoir 50 and the plenum 40. Passageway 60 supports a check valve assembly 62 therein. Assembly 62 may be inserted into the passageway or attached therein. The check valve assembly is generally cylindrical and has an inner wall 64 which his apertured by bore or flow passage 66. A flexible flapper member 68 is located on the rightward or reservoir side of wall 64. The flapper member 68 has a freely movable edge portion 70 and hinged edge portion 72.

When the intake manifold 10 is being used with an active internal combustion engine under closed (idle) or near closed throttle conditions, the movement of the pistons in the engine cylinders creates a suction and subatmospheric condition (vacuum) in the interior of the manifold. The vacuum condition from each cylinder is communicated to the interior 40' of the plenum housing 40 through the four branch runners 42, 44, 46 and 48. The vacuum condition in plenum interior 40' causes the freely movable edge portion 70 of flapper 68 to the left in FIG. 2 which opens the flow passage 66 to allow air to flow therethrough from the interior 50' of reservoir into the interior 40' of the manifold 40. This generates a subatmospheric condition or a vacuum within the reservoir interior 50'. In a typical application of the present invention, when the engine is idled (throttle effectively closed), the level of vacuum in the plenum can approach about 19–25 mmHg and when vacuum using components are not active the vacuum in the interior 50' can also reach about 19–25 mmHg. However, as various vacuum actuated components are actuated, air will flow into the interior 50' of the reservoir 50 via a connecting hose (not shown) and through the nipple-like fitting 82. In the illustrated example, there is only one fitting 82. However, it will be obvious to those skilled in the art that a multitude of fittings can also be provided. In fact, many vehicle embodiments prefer to provide a separate fitting feed only the brake vacuum booster and to provide another fitting for all the other components combined.

As the engine's throttle is opened, the vacuum level within the plenum 40 decreases. Under these conditions, the vacuum level within the reservoir may exist at a greater level than the vacuum level within the plenum 40 (meaning at a lower subatmospheric pressure). When this occurs, the freely movable lower edge portion 70 of the flapper 68 is urged to the right as shown in FIG. 2 to block passage 66 which isolates the interior 50' of the reservoir 50 from the interior 40' of the manifold plenum 40. If desirable, the material and configuration of the check valve 62 can be selected to perform at a different pressure differential cut-off point for accommodating various manifolds or different vehicle vacuum component options.

The present vehicle intake manifold with its integral vacuum reservoir has been shown in a preferred embodiment. However, it will be apparent to those skilled in the art, the various modifications can be made to the present invention without departing from the spirit or scope of the present invention as it is an encompassed in the specification and drawings and by the following claims.

What is claimed is:

1. An intake manifold for a vehicle engine with vacuum storage, comprising:

a manifold enclosure defining an interior including a plenum space and having an inlet for receiving air thereto;

said plenum space fluidly connected to said inlet to provide a substantial volume of air for the associated engine;

a plurality of branch runners fluidly connected to said plenum space, each runner delivering air from said plenum space to a cylinder of the associated vehicle engine;

a vacuum reservoir enclosure defining an interior control space, said vacuum reservoir enclosure acting as a source of vacuum for the vehicle's vacuum using component;

an integral passageway formed between separated boundary walls of said plenum space and said vacuum reservoir; and a check valve totally supported in said integral passageway between said plenum and said vacuum reservoir boundary walls allowing the flow of air from said vacuum reservoir into said plenum but blocking air flow in the reverse direction.

2. An intake manifold with vacuum storage as described in claim 1, wherein said plenum and vacuum reservoir assembly is integrally formed.

3. An intake manifold with vacuum storage as described in claim 2, wherein said manifold enclosure and vacuum enclosure are injection molded.

4. An intake manifold with vacuum storage as described in claim 3, wherein said manifold and said vacuum reservoir assembly is molded by formation of a pair of complementary clam shell structures which are subsequently edge joined together.

5. An intake manifold with vacuum storage as described in claim 4, wherein the edges of said clam shell structures are sonically welded together.

6. An intake manifold with vacuum storage as described in claims 1, wherein said manifold enclosure and vacuum enclosure are of polymeric material.

7. An intake manifold with vacuum storage as described in claim 1, wherein said check value has a flapper-like construction including a movable flapper member hinged at one edge location to allows the remainder of the edge structure to move into an opened position in response to differentials in pressure so as to allow passage of air from said vacuum reservoir into said intake manifold.

8. An intake manifold with vacuum storage as described in claim 1, and a fitting leading to the interior of said reservoir enclosure for operative connection to a vehicle vacuum component.

9. An intake manifold with vacuum storage for a vehicle engine comprising:

an injection molded and substantially hollow assembly defining an inlet passage means for receiving air and delivering the air to the associated engine, said enclosure assembly made by injection molding of a plastic material, the molding involving the formation of claim shell shaped half members which are subsequently weld attached at their edge portions;

said enclosure assembly forming an interior air plenum connected to the inlet for providing a gaseous reservoir space;

said enclosure assembly including a plurality of branch runners fluidly connected with said plenum, each runner delivering air from said plenum to a cylinder of the associated engine;

said enclosure assembly defining a vacuum reservoir defining an internal control space for vacuum storage available for operation of various associated vacuum components of the vehicle, said vacuum reservoir being integrally formed with said plenum;

said vacuum reservoir portion of said enclosure assembly having an extending nipple-like fitting adapted for connection with a hose to route vacuum to said associated vacuum components;

air passageway means formed between boundary walls of said plenum portion and said reservoir portion of said enclosure assembly to fluidly communicate the two interiors; and said air passageway means totally supported within said air passageway including a one-way check valve to block air flow from said plenum into said reservoir but to permit air flow from said reservoir into said plenum.

* * * * *